US005984123A

United States Patent [19]

Mogami et al.

[11] Patent Number: 5,984,123

[45] **Date of Patent: *Nov. 16, 1999**

[54] CONTAINER HAVING SCREW-THREADED CAPTIVE CAP

[75] Inventors: Tatsuro Mogami, Ichinomiya; Akira Miyazaki, Inazawa; Sumio Watanabe, Aichi-ken; Masaharu Nakao, Otsu, all of Japan

[73] Assignees: Eisai Co., Ltd., Tokyo; Taisei Kako Co., Ltd., Osaka, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/750,791

[22] PCT Filed: Apr. 9, 1996

[86] PCT No.: PCT/JP96/00970

§ 371 Date: Feb. 27, 1997

§ 102(e) Date: Feb. 27, 1997

[87] PCT Pub. No.: WO96/32339

PCT Pub. Date: Oct. 17, 1996

[30] Foreign Application Priority Data

Apr. 10, 1995 [JP] Japan ..... 7-107799

[51] Int. Cl.[6] ..... B65D 41/04

[52] U.S. Cl. ..... 215/235; 215/306; 215/331; 220/291; 220/837

[58] Field of Search ..... 215/235, 237, 215/245, 330, 331, 334, 335, 339, 306, 332, 337; 220/337, 339, 335, 375, 259, 836, 837, 810

[56] References Cited

U.S. PATENT DOCUMENTS

| | | | |
|---|---|---|---|
| 2,937,781 | 5/1960 | Leach . | |
| 3,059,816 | 10/1962 | Goldstein . | |
| 3,199,704 | 8/1965 | Davison | 215/334 |
| 3,315,830 | 4/1967 | Flynn | 215/334 |

(List continued on next page.)

FOREIGN PATENT DOCUMENTS

| | | |
|---|---|---|
| 391236 | 10/1932 | Belgium . |
| 1 164 846 | 5/1958 | France . |
| 533590 | 2/1941 | United Kingdom . |
| 91/18799 | 12/1991 | WIPO . |

*Primary Examiner*—Stephen Castellano
*Attorney, Agent, or Firm*—Pillsbury Madison & Sutro LLP

[57] ABSTRACT

A packaging container having a container body and a lid unit which is undetachably mounted on the container body. The container body has a neck portion provided with an opening. An external thread cut in the outer periphery of the neck portion, and a lid mounting portion is provided below the external thread. The lid unit has a lid body and a fitting member. The lid body is provided with an internal thread engageable with the external thread of the container body, and has a function of hermetically sealing the opening of the container body. The fitting member is rotatably fitted around the lid mounting portion of the container body, but vertical movement of the fitting member is restricted within a predetermined range. The fitting member is held undetachable from the lid mounting portion by a collar of the container body. The lid body and the fitting member are connected to each other by a connecting member in such a manner that the lower surface of the lid body can rest on and separate from the upper surface of the fitting member.

16 Claims, 8 Drawing Sheets

U.S. PATENT DOCUMENTS

| | | | |
|---|---|---|---|
| 3,741,447 | 6/1973 | Miles et al. | 220/837 X |
| 4,238,042 | 12/1980 | Hataeyama et al. | 215/334 |
| 4,273,248 | 6/1981 | Lehmann | 215/334 X |
| 4,280,632 | 7/1981 | Yuhara | 215/334 X |
| 4,289,248 | 9/1981 | Lynn | 215/331 X |
| 4,373,641 | 2/1983 | Banich, Sr. et al. | 215/331 |
| 4,591,063 | 5/1986 | Geiger | 215/330 |
| 4,753,358 | 6/1988 | Virca et al. . | |
| 4,770,308 | 9/1988 | Lynn | 215/330 |
| 5,143,234 | 9/1992 | Lohrman et al. | 215/331 X |
| 5,145,080 | 9/1992 | Imbery, Jr. | 215/331 |
| 5,169,035 | 12/1992 | Imbery, Jr. . | |
| 5,215,204 | 6/1993 | Beck et al. . | |
| 5,271,512 | 12/1993 | Ekkert | 215/330 X |
| 5,423,442 | 6/1995 | Nozawa et al. | 215/237 X |
| 5,484,070 | 1/1996 | Graham | 220/837 X |
| 5,531,349 | 7/1996 | Wojcik et al. | 220/335 X |
| 5,560,505 | 10/1996 | Schneider et al. | 215/331 X |

CONTAINER HAVING SCREW-THREADED CAPTIVE CAP

This application is the national phase of international application PCT/JP96/00970, filed Apr. 9, 1996 which designated the U.S.

BACKGROUND OF THE INVENTION

1.Field of the Invention

The present invention relates to a packaging container and, more particularly, to a packaging container which is arranged such that the lid of the container does not separate from the container body when the container is opened.

2. Description of the Background Art

In pharmacies or other places where dispensing is performed, it is common to store a great variety of drugs for dispensing in the same drawer or on the same shelf. Generally, the indicator label of a drug is attached to the trunk portion of the drug packaging container. However, in a case where a great variety of drugs are stored together in the same drawer or on the same shelf as described above, it is often difficult to confirm the names, contents, etc. of the drugs as stored in this way, and it is necessary to take them out one by one in order to make confirmation. Accordingly, if the top of the lid of the container for each drug is provided with an indication for identification of the drug, it is possible to remarkably improve the efficiency of the work of delivering drugs to a dispensary and also the efficiency of the dispensing work, which always require rapid performance. Moreover, it is extremely important to provide such an identification indication on the top of the lid of each drug container from the viewpoint of preventing erroneous dispensing. In fact, there have heretofore been strong user demands that such an indication should be provided on the top of the lid of each drug container.

However, many of packaging containers used for ordinary drugs have a structure in which the lid is fitted on the container body by thread engagement or the like; when the container is opened, the lid separates from the container body. Accordingly, when a plurality of drugs contained in such containers of the same opening diameter are used, there is a possibility that the lid of some container will be put on a wrong container after the drugs have been used. Accordingly, the risk of erroneous prescription accompanies the provision of an indication for drug identification on the top of the lid of a packaging container having the conventional structure, or the attachment of a drug name and content indicating label for the top indication to the conventional packaging container.

Incidentally, there is a packaging container designed so that, even when the container is opened, the lid thereof does not separate from the container body, for example, a packaging container with a hinged cap having a hinge structure which is generally known as "three-point hinge structure", as disclosed, for example, in Japanese Utility Model Application Unexamined Publication (KOKAI) No. 6-20261 (Japanese Utility Model Application No. 4-47436).

The above-described packaging container uses a hinged cap which is formed by joining together a cap body and a top lid by hinges. The cap body is secured to the top of the container body by using threads or the like, and a tubular portion of the top lid is fitted into an outlet opening provided in the top wall of the container body, thereby hermetically sealing the container.

However, the container having the above-described structure suffers from the problem that it is difficult to ensure the hermeticity when the outlet opening is enlarged, because the tubular portion of the top lid is fitted into and removed from the outlet opening by rotating the top lid about the hinged portion.

Accordingly, it is difficult to adopt the conventional container structure for drug packaging containers which are used to contain solid preparations such as powders, granules, tablets, capsules, etc. and required to have a large opening diameter in order to allow a desired amount of drug to be taken in and out of them, and which are demanded to ensure a high degree of hermeticity.

SUMMARY OF THE INVENTION

In view of the above-described circumstances, an object of the present invention is to provide a packaging container which is particularly suitable for use as a packaging container for a drug or the like and superior in hermeticity despite a large opening diameter, and which is designed so that the lid thereof does not separate from the container body when the container is opened.

Another object of the present invention is to provide a packaging container of the type described above which is further designed to be capable of being opened and closed by a one-touch simple operation using snap-action hinged joining in order to improve usability.

Still another object of the present invention is to provide a packaging container of the type described above which is further designed so that, even when the lid body is raised to open the container, a portion of the lid which is secured to the container body is held in the fixed position, thereby making it convenient for the subsequent containing closing operation.

The packaging container according to the present invention is arranged as follows: A container body is provided with a neck portion having an opening at the upper end thereof. The neck portion has an external thread cut in the upper portion of the outer periphery thereof, and a cylindrical lid mounting portion which is formed below the external thread. A lid unit for opening and closing the opening of the container body comprises a lid body for opening and closing the opening, and a fitting member which is connected to the lid body and undetachably fitted around the lid mounting portion of the container body. The lid body has a cylindrical side wall provided on the inner periphery thereof with an internal thread which is engageable with the external thread of the container body, and a top wall which closes the top of the side wall. The fitting member has a cylindrical portion which is rotatably and undetachably fitted around the lid mounting portion in such a manner that vertical movement of the fitting member relative to the lid mounting portion is restricted within a predetermined range. The lid body and the fitting member are connected by a connecting member in such a manner that the lower surface of the side wall of the lid body can rest on and separate from the upper surface of the fitting member.

In one embodiment of the present invention, the connecting member is provided as a hinge which is provided near the outer peripheries of the lid body and fitting member. The hinge is formed from a foldable thin-walled portion which is provided in the joint of the lid body and the fitting member when these members are integrally molded from a plastic material.

In another embodiment of the present invention, the lid body comprises an inner lid and an outer lid. The inner lid has a cylindrical side wall and a top wall which closes the upper end of the side wall. The outer lid fixedly receives the inner lid therein by using a rotation preventing device and a removal-preventing device. The fitting member is connected to the outer lid, and a spring member is provided between the outer lid and the fitting member. The spring member biases the lid body in a direction in which the lid body rests on the fitting member or in a direction in which the lid body separates from the fitting member when the lid body has passed a neutral point during pivoting relative to the fitting member.

In still another embodiment of the present invention, the connecting member includes an extending member which extends between the lid body and the fitting member, whereby the lid body and the fitting member can lie separate from each other.

In a further embodiment of the present invention, the container body and the cylindrical portion of the fitting member are provided with respective slide-preventing members which engage with each other when the lid body rotates relative to the container body as far as a position where the external thread and the internal thread disengage from each other, to prevent downward movement of the fitting member.

The above and other objects, features and advantages of the present invention will become more apparent from the following description of the preferred embodiments thereof, taken in conjunction with the accompanying drawings, in which like reference numerals denote like elements.

BRIEF DESCRIPTION OF THE DRAWINGS

FIGS. 1*a,* 1*b* and 1*c* are side views of a packaging container according to a first embodiment of the present invention, in which: FIG. 1*a* shows the packaging container in a closed state.

DESCRIPTION OF THE PREFERRED EMBODIMENTS

Embodiments of the present invention will be described below with reference to the accompanying drawings. It should be noted that the scope of the present invention is not necessarily limited to the following embodiments.

Figure 1A:
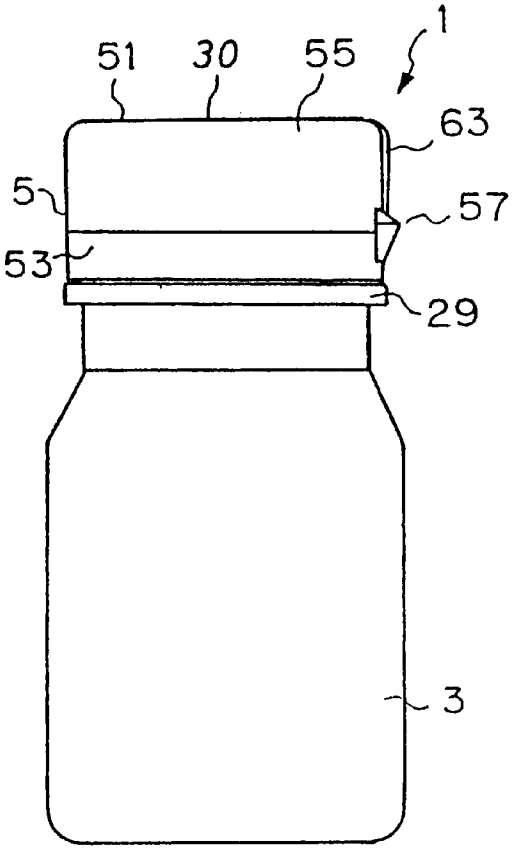
Figure 1B:
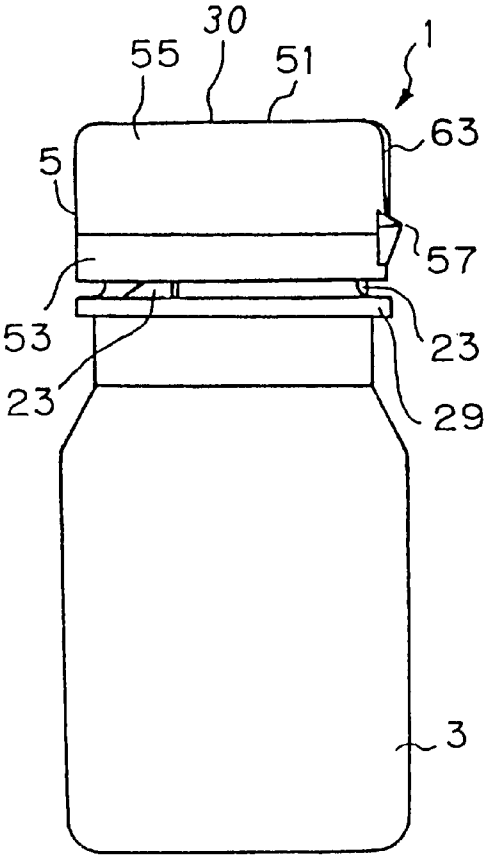
FIG. 1*b* shows the packaging container in an openable state.
Figure 1C:
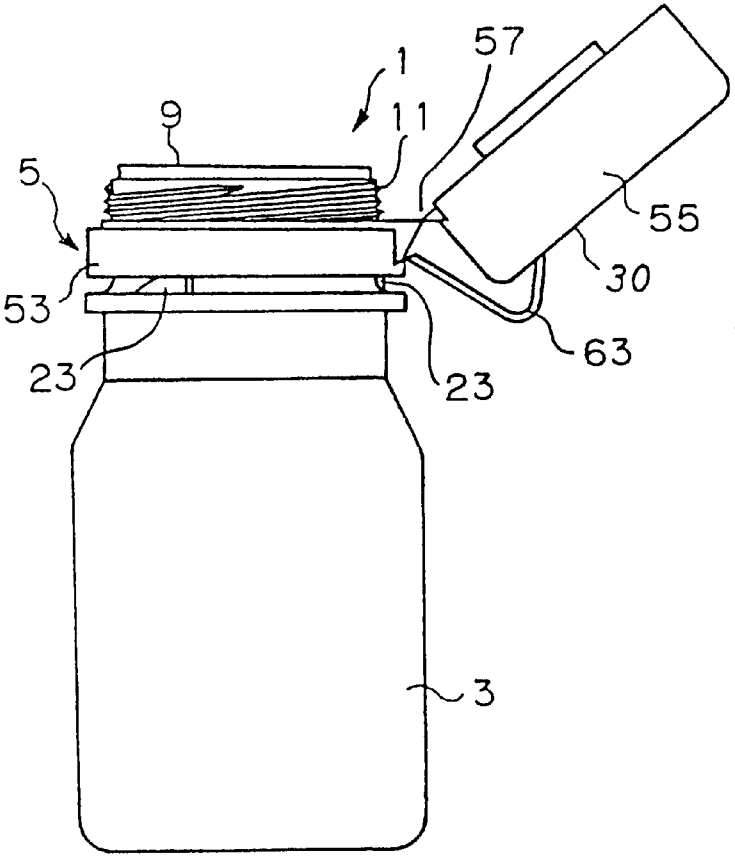
FIG. 1*c* shows the packaging container in an unclosed state.

FIGS. 1*a,* 1*b* and 1*c* are side views of a packaging container 1 according to a first embodiment of the present invention, in which: FIG. 1*a* shows the packaging container 1 in a closed state; FIG. 1*b* shows the packaging container 1 in an openable state; and FIG. 1*c* shows the packaging container 1 in an open state. The packaging container 1 includes a container body 3, and a lid unit 5 which is mounted on the container body 3 so as to open and close an outlet opening of the container body 3. FIG. 1*a* shows the packaging container 1 in a state where the lid unit 5 is in a closing position relative to the container body 3. In this state, the packaging container 1 cannot be opened. If the lid unit 5 is rotated through a predetermined angle from the position shown in FIG. 1*a,* the packaging container 1 is brought into an openable state as shown in FIG. 1*b*. Thus, as shown in FIG. 1*c,* a lid body 30 (described later) of the lid unit 5 can be raised from the container body 3 to unstop the packaging container 1. The packaging container 1 will be described below in detail.

Figure 2:
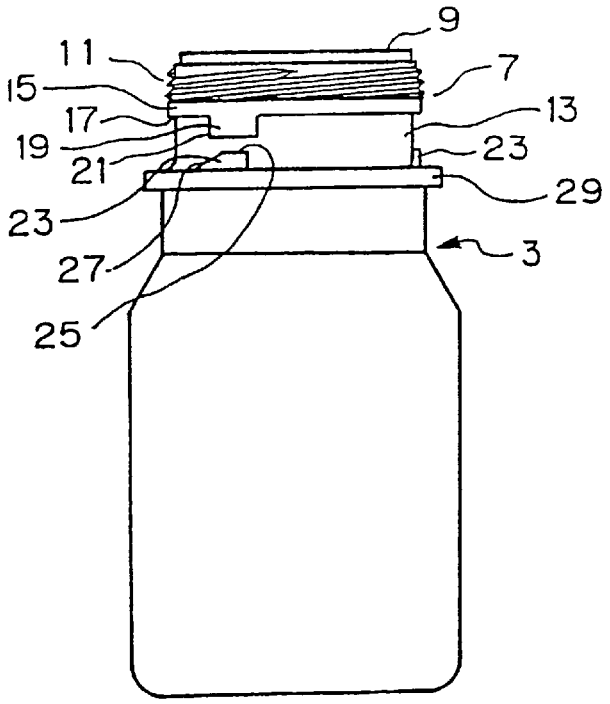
FIG. 2 is a side view of a container body of the packaging container according to the embodiment.

FIG. 2 is a side view of the container body 3. The container body 3 is made of a plastic material. The container body 3 has a neck portion 7 which is provided at the upper end thereof with an opening 9 which leads to the inside of the container 1. The upper portion of the neck portion 7 is formed with an external thread 11. A short collar 15 is provided below the external thread 11, and a cylindrical lid mounting portion 13 is formed below the collar 15. The diameter of the lid mounting portion 13 is slightly smaller than the diameter of the collar 15. The lid unit 5 (described later) is undetachably mounted on the lid mounting portion 13. Although in this embodiment the external thread 11 is a quadruple thread, the external thread 11 is not necessarily limited to it.

A first projection 19 having a side surface 21 projects downwardly from the lower surface 17 of the collar 15 along the lid mounting portion 13 or radially outward from the lid mounting portion 13. The first projection 19 functions as a rotation preventing stop 19 which limits the rotation of a fitting member 53 of the lid unit 5 (described later). Further, a lower collar 29 is formed at the lower end of the lid mounting portion 13, and second projections 23 project upwardly from the collar 29 along the lid mounting portion 13 or radially outward from the lid mounting portion 13. As will be described later, the second projections 23 function as slide-preventing stops 23 in such a manner that, when the lid unit 5 rotates through a predetermined angle relative to the container body 3 so as to undo the thread engagement between the lid unit 5 and the container body 3 while moving upwardly by a predetermined amount, the second projections 23 retain the fitting member 53 of the lid unit 5 to prevent the lid unit 5 from sliding downwardly, even when the lid body 30 is raised to open the container 1. As shown in FIG. 2, each slide-preventing stop 23 has an upper end surface 25 and a slant surface 27 which is contiguous to one side edge of the upper end surface 25. In this embodiment, the container body 3 has one rotation-preventing stop 19 and three slide-preventing stops 23 which are circumferentially spaced at equal intervals. The functions of the rotation-preventing stop 19 and slide-preventing stop 23 will be detailed later.

Figure 3:
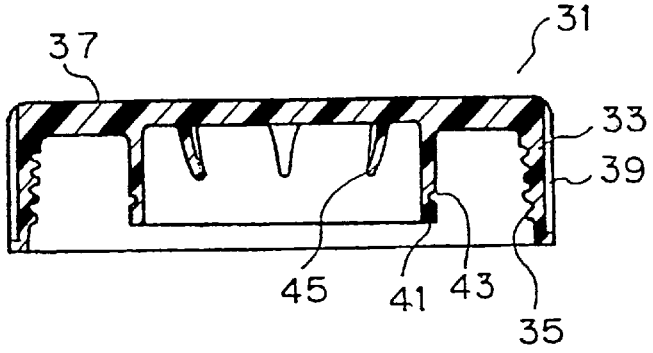
FIG. 3 is a sectional view of an inner lid of the packaging container according to the embodiment.

FIG. 3 is a sectional view of an inner lid 31 made of a plastic material as one member which constitutes the lid unit 5. The inner lid 31 has a cylindrical side wall 33, and a top wall 37 which closes the upper end of the side wall 33. The inner peripheral surface of the side wall 33 is provided with an internal thread 35 which is engageable with the external thread 11 of the container body 3. Accordingly, when the internal thread 35 of the inner lid 31 is engaged with the external thread 11 of the container body 3, the container body 3 is completely hermetically sealed.

The outer periphery of the side wall 33 of the inner lid 31 is formed with four narrow longitudinal grooves 39 which extend in the longitudinal direction of the side wall 33. The longitudinal grooves 39 are circumferentially spaced at equal intervals. The function of the longitudinal grooves 39 will be detailed later. An inner side wall 41 extends downwardly from the inner surface of the top wall 37 in concentric relation to the side wall 33. The inner side wall 41 has a circumferential groove 43 formed in the outer periphery of the lower end portion thereof. The height of the inner side wall 41 is shorter than the height of the side wall 33. Further, four elongate tongues 45 extend downwardly from the inner surface of the top wall 37 so as to lie inside the inner side wall 41. The tongues 45 are equally spaced in concentric relation to the side wall 33. Each tongue 45 has a configuration in which it is gently bent toward the center of the top wall 37 as the distance from the top wall 37 increases toward the lower end of the tongue 45. The circumferential groove 43 and the tongues 45 will be detailed later.

Figure 4:
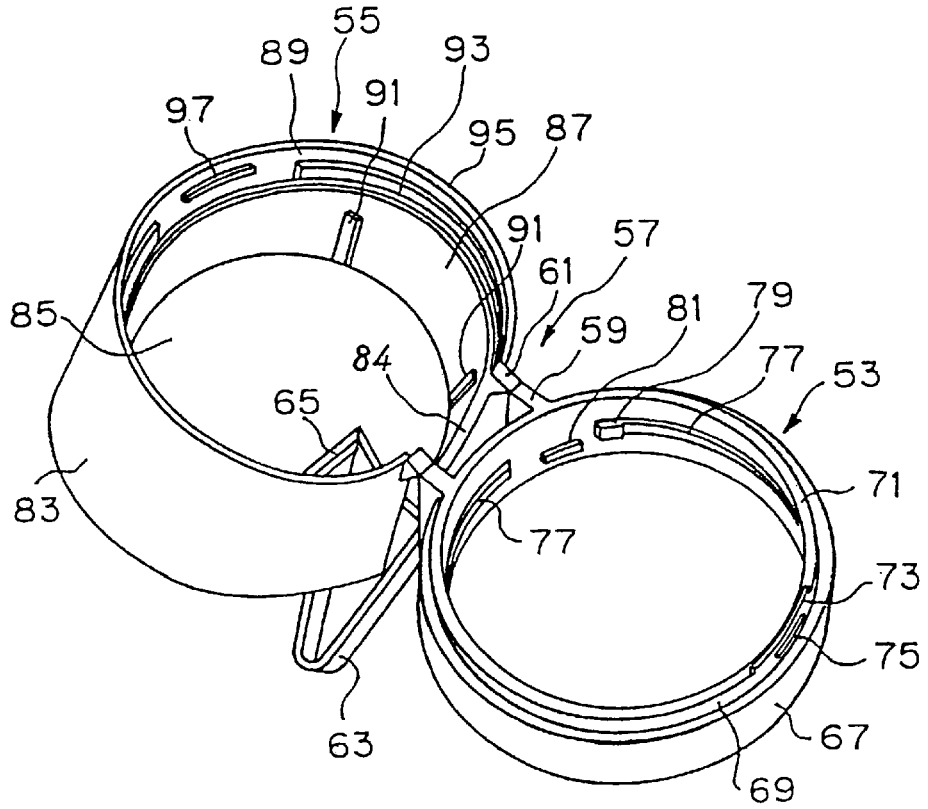
FIG. 4 is a perspective view showing an outer lid and a fitting member, which constitute a lid unit of the packaging container according to the embodiment.

FIG. 4 is a perspective view showing an outer lid 55 for receiving the inner lid 31, which also constitutes the lid unit 5, and a fitting member 53 which is undetachably fitted on the container body 3. In this embodiment, the outer lid 55 and the fitting member 53 are integrally formed from a plastic material. The fitting member 53 is fitted around the lid mounting portion 13 of the container body 3, thereby undetachably mounting the lid unit 5 on the container body 3. The outer lid 55 receives the above-described inner lid 31 therein as one unit to form the lid body 30. The outer lid 55 and the fitting member 53 are joined together by hinges 57 so as to be pivotable relative to each other. More specifically, as shown in FIG. 4, the hinges 57 are provided at two positions in parallel to each other. Each hinge 57 has a structure in which short arms 59 and 61 which extend from the fitting member 53 and the outer lid 55, respectively, are connected at their distal ends by a thin plastic film formed by integral molding process, so that the arms 59 and 61 are foldable at the thin-film portion. That is, the outer lid 55, or the lid body 30, is pivotable relative to the fitting member 53 about the hinges 57. Further, the outer lid 55 has a cut portion 84 formed at a position between the two arms 61. The cut portion 84 extends from the lower end of the side wall 83 to the top wall 85 of the outer lid 55. Reference numeral 63 denotes an approximately V-shaped spring member which is integrally molded with the outer lid 55 and the fitting member 53. The spring member 63 is disposed by utilizing the cut portion 84. That is, one end of the spring member 63 is connected to the top wall side end of the cut portion 84 by a thin plastic film 65 which functions as a hinge, and the other end of the spring member 63 is connected to that circumferential portion of the outer periphery of a cylindrical portion 67 constituting the fitting member 53 which faces the cut portion 84 by a thin plastic film (not shown) which functions as a hinge, so that the spring member 63 is foldable at the thin plastic film portions. The spring member 63 provides a snap action. That is, when the outer lid 55 is pivoted relative to the fitting member 53 between an open position as illustrated in FIG. 4 and a closed position where the outer lid 55 is placed to fit on or around the fitting member 53, the spring member 63 biases the outer lid 55 toward either the open position or the closed position when the outer lid 55 has passed a neutral point during the pivoting motion. The hinges 57 and the spring member 63 are also described in the aforementioned Japanese Utility Model Application Unexamined Publication (KOKAI) No. 6-20261; therefore, further description thereof is omitted.

The fitting member 53 is a cylindrical member comprising a lower first tubular portion 67 and a second tubular portion 69 which is formed on the first tubular portion 67. The second tubular portion 69 is shorter in height and outer diameter than the first tubular portion 67 although the inner diameter of the second tubular portion 69 is the same as that of the first tubular portion 67. A thin-walled wall 73 with a predetermined length is formed on the upper surface 71 of the second tubular portion 69 at a position diametrically opposite to the above-described hinges 57 in the shape of a circular arc extending along the second tubular portion 69. The outer peripheral surface of the wall 73 is formed with an elongated low projection with a predetermined length extending in the shape of a circular arc as an engagement projection 75 for locking the outer lid 55.

The inner peripheral surface of the fitting member 53 is formed with circumferentially elongated projections at an approximately central position in the heightwise direction of the fitting member 53 as removal-preventing abutments 77 for preventing the fitting member 53 from coming off the neck portion 7 of the container body 3. In this embodiment, the fitting member 53 has three removal-rotation-preventing abutments 77 which are circumferentially spaced at appropriate intervals (in this embodiment, the abutments 77 comprise three abutments 77*a*, 77*b* and 77*c* having different lengths; however, these are represented by reference numeral 77). The removal-preventing abutments 77 are provided to correspond to the collar 15 of the above-described container body 3. When the fitting member 53 fitted on the lid mounting portion 13 moves upwardly by a predetermined distance, the removal-preventing abutments 77 abut against the lower surface 17 of the collar 15 of the container body 3, thereby preventing the fitting member 53 from coming off the neck portion 7 of the container body 3. It should, however, be noted that the configuration of the removal-preventing abutments 77 may be appropriately changed according to need.

A projection 79, which functions as a rotation-preventing engagement portion, is formed at one end of one of the three removal-preventing abutments 77 in contiguity with the abutment 77 so as to correspond to the rotation-preventing stopper 19 of the container body 3. When the rotation-preventing engagement portion 79 abuts against the side surface 21 of the rotation-preventing stopper 19, the fitting member 53, and hence the lid unit 5, cannot further rotate in the same direction.

The inner peripheral surface of the fitting member 53 is further formed with projections or elongated projections which function as slide-preventing engagement portions 81 at a heightwise position lower than the removal-preventing abutments 77. The slide-preventing engagement portions 81 each extend circumferentially by a predetermined length in the same way as the removal-preventing abutments 77, although the engagement portions 81 are shorter than the abutments 77. The slide-preventing engagement portions 81 are provided to correspond to the slide-preventing stoppers 23. When the fitting member 53 is rotated around the lid mounting portion 13 as far as a position where the rotation-preventing projection 79 abuts against the side surface 21 of the rotation-preventing stopper 19 of the container body 3, the slide-preventing engagement portions 81 rest on the upper surfaces 25 of the slide preventing stoppers 23 to prevent downward movement of the fitting member 53 at this position in the rotational direction.

The outer lid 55 has a cylindrical side wall 83 and a top wall 85 which substantially closes the upper end of the side wall 83. The side wall 83 comprises a thick-walled, upper first tubular portion 87 and a thin-walled second tubular portion 89 which is equal in the outer diameter to but larger in the inner diameter than the first tubular portion 87. The inner diameter of the first tubular portion 87 is set to a dimension corresponding to the outer diameter of the inner lid 31, so that the first tubular portion 87 can receive the inner lid 31. The inner peripheral surface of the first tubular portion 87 is provided with longitudinally elongated projections 91 which are slightly raised at respective positions corresponding to the longitudinal grooves 39 of the inner lid 31. With the longitudinal grooves 39 fitted with the longitudinally elongated projections 91, the inner lid 31 is received in the first tubular portion 87 in such a manner as to be prevented from rotating relative to the outer lid 55. A circumferentially elongated projection 93 which is slightly raised is formed on the inner peripheral surface of the first tubular portion 87 at a position close to the second tubular portion 89 as a removal preventing engagement portion for preventing the inner lid 31 from coming off the first tubular portion 87. The heightwise dimension from the inner surface of the top wall 85 to the removal-preventing engagement portion 93 is determined in conformity to the height of the inner lid 31. Accordingly, when the inner lid 31 is received in the first tubular portion 87, the lower end portion of the inner lid 31 is retained by the come-off preventing engagement portion 93. Thus, the inner lid 31 is held by the outer lid 55 as one unit, in such a manner as to be prevented from coming off the outer lid 55. In another embodiment, the outer surface of the top wall 37 of the inner lid 31 may be bonded to the inner surface of the top wall 85 of the outer lid 55 by using an adhesive. In the case of a container with a relatively large diameter, the inner lid 31 can be secured to the outer lid 55 even more reliably by using bonding in combination with the above-described mechanisms for preventing the inner lid 31 from coming off and from rotating relative to the outer lid 55.

The inner peripheral surface of the thin-walled second tubular portion 89 is formed with a circumferentially elongated, short, slightly raised projection in the shape of a circular arc at a position diametrically opposite to the hinges 57 as a projection 97 to be engaged. When the outer lid 55 is placed around the fitting member 53, the second tubular portion 89 of the outer lid 55 fits over the outer periphery of the second tubular portion 69 of the fitting member 53, and at that time, the projection 97 rides over the engagement projection 75, thereby locking the outer lid 55 to the fitting member 53.

Figure 5:
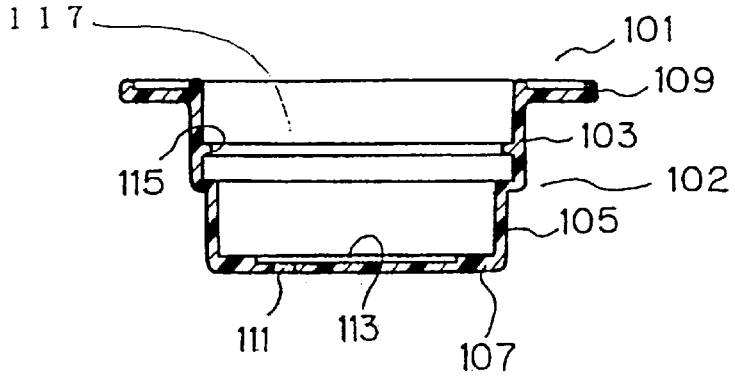
FIG. 5 is a sectional view of a center lid of the packaging container according to the embodiment.

FIG. 5 is a sectional view of a center lid 101 which is fitted inside the inner lid 31. The center lid 101 has a tubular portion 102 including a large-diameter portion 103 and a small-diameter portion 105, a bottom wall 107 which closes the bottom of the tubular portion 102, and a flange 109 which extends radially outward from the upper end of the large-diameter portion 103. The inner peripheral surface of the large-diameter portion 103 is formed with a circumferentially elongated projection 115. The center lid 101 is mounted on the inner lid 31 by fitting the elongated projection 115 into the circumferential groove 43 of the inner lid 31. A desiccating agent 120 or other appropriate substance is accommodated in a cavity 117 in the tubular portion 102 and held down by the tongues 45 of the inner lid 31. The bottom wall 107 is provided with a vent hole 111. A plurality of shallow grooves or recesses 113 having an appropriate planar configuration are formed in the inner surface of the bottom wall 107 so as to communicate with each other, thereby ensuring a maximal area of contact between the desiccating agent 120 and the air.

Figure 6:
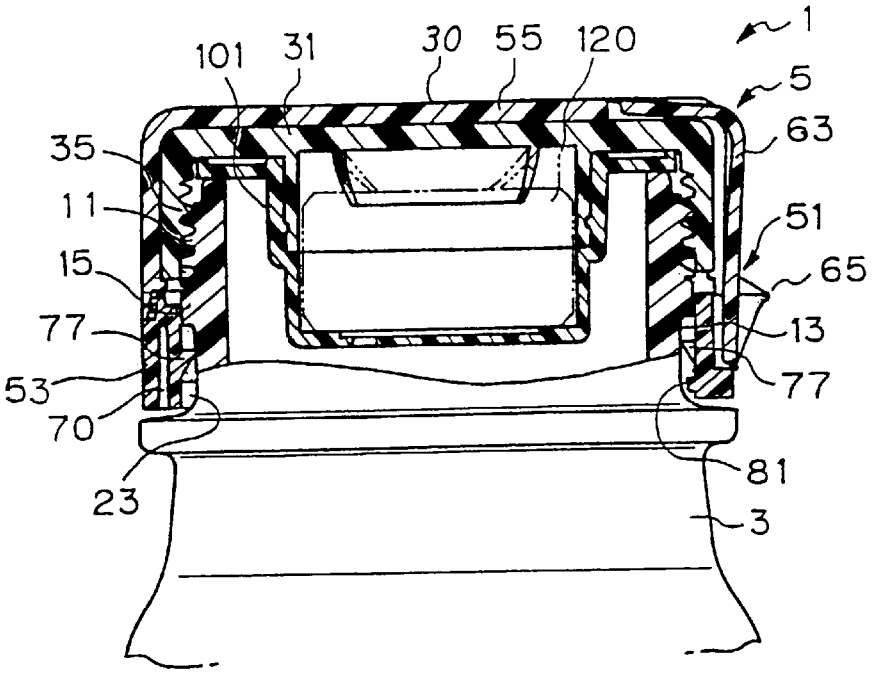
FIG. 6 is a fragmentary sectional view of the packaging container in a closed state.

FIG. 6 is a fragmentary sectional view showing the lid unit 5 which is mounted on the container body 3 in such a manner that the internal thread 35 of the inner lid 31 is engaged with the external thread 11 of the container body 3, thereby completely closing the container body 3. FIG. 6 corresponds to FIG. 1*a*. It should be noted that, to initially mount the lid unit 5 onto the container body 3, the inner lid 31 is secured in the outer lid 55, and the outer lid 55 is placed to fit around the fitting member 53. That is, the lid unit 5 is brought into the closed position, and in this state, it is fitted onto the neck portion 7 of the container body 3. In order to facilitate the operation of fitting the lid unit 5, as shown in FIG. 6, the cylindrical portion of the fitting member 53 has been slit from the lower end thereof to a predetermined position, as indicated by reference numeral 70 in the figure, except the portion where the hinges 57 are provided. Thus, the cylindrical portion of the fitting member 53 has a double-wall structure. Alternatively, the cylindrical portion of the fitting member 53 may have a cut made in a circumferential portion thereof. It should be noted that it is necessary to conduct the fitting operation by taking into consideration the positional relationship in the rotational direction between the rotation-preventing stop 19 of the container body 3 and the rotation-preventing engagement portion 79 of the fitting member 53. After the removal-off preventing abutments 77 of the fitting member 53 have passed over the collar 15 of the container body 3 and fitted into the lid mounting portion 13, the lid unit 5 is then rotated in the closing direction, causing the internal thread 35 of the inner lid 31 to be tightly engaged with the external thread 11 of the container body 3. In this way, the lid unit 5 is tightened, and the container 1 is hermetically sealed.

Figure 8A:
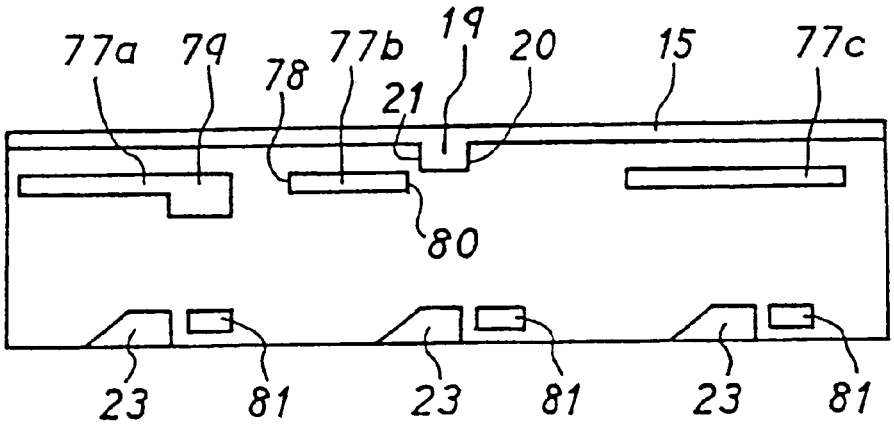
FIG. 8*a* schematically shows the positional relationship between constituent elements of rotation and slide preventing devices of the packaging container in the closed state.

FIG. 8*a* is an interior elevation of the lid mounting portion 13 of the container body 3 and the fitting member 53 fitted thereon in the above-described state, schematically showing the positional relationship between, on the one hand, the collar 15, the rotation-preventing stop 19 and the slide-preventing stops 23 of the container body 3 and, on the other, the removal-off preventing abutments 77, the rotation preventing engagement portion 79 and the slide-preventing engagement portions 81 of the fitting member 53. As will be clear from the figure, the removal-preventing abutments 77 are not in contact with the collar 15, and the rotation-preventing engagement portion 79 is not in contact with the rotation-preventing stop 19. Further, the slide-preventing engagement portions 81 are not on the slide-preventing stop 23.

It should be noted that, in the closed state, the flange 109 of the center lid 101 is compressed between the inner surface of the inner lid 31 and the end surface of the opening 9 of the container body 3 to enhance the hermeticity of the container 1. Further, the tongues 45 push downwardly the desiccating agent 120 accommodated in the center lid 101 and press it against the bottom wall 107 of the center lid 101. Therefore, even when the container 1 is tilted, the drug in the container 1 is prevented from entering the center lid 101 through the vent hole 111.

Figure 7:
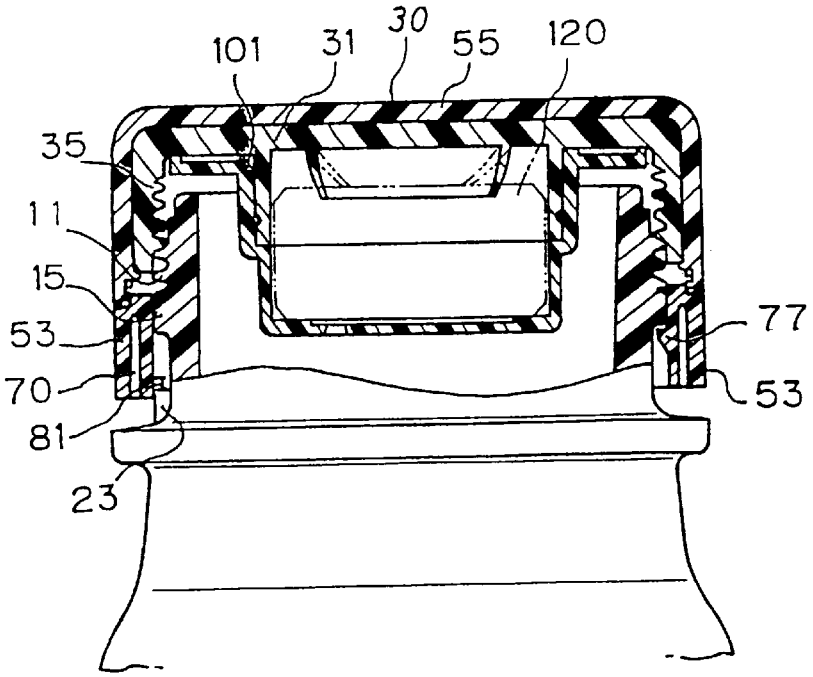
FIG. 7 is a fragmentary sectional view of the packaging container in an openable state.
Figure 8B:
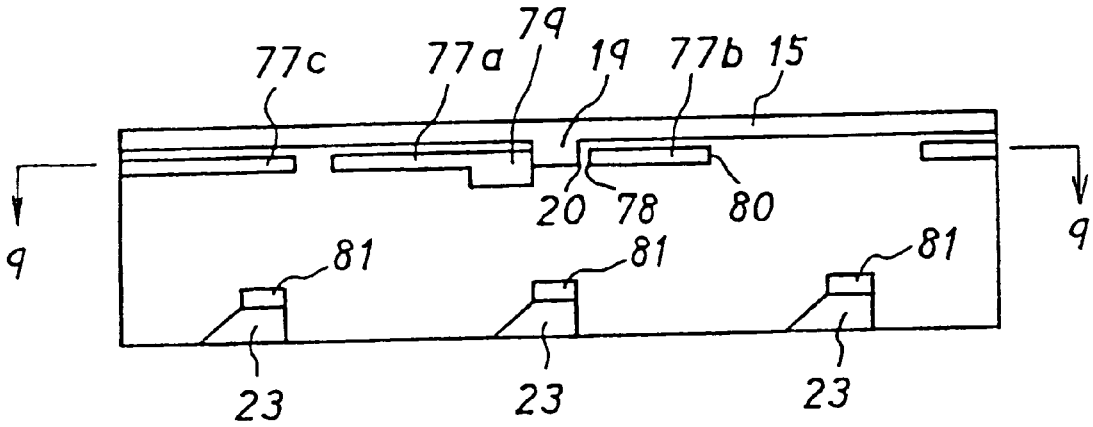
FIG. 8*b* schematically shows the positional relationship between the constituent elements of the rotation-preventing and slide-preventing devices of the packaging container in the openable state.
Figure 9:
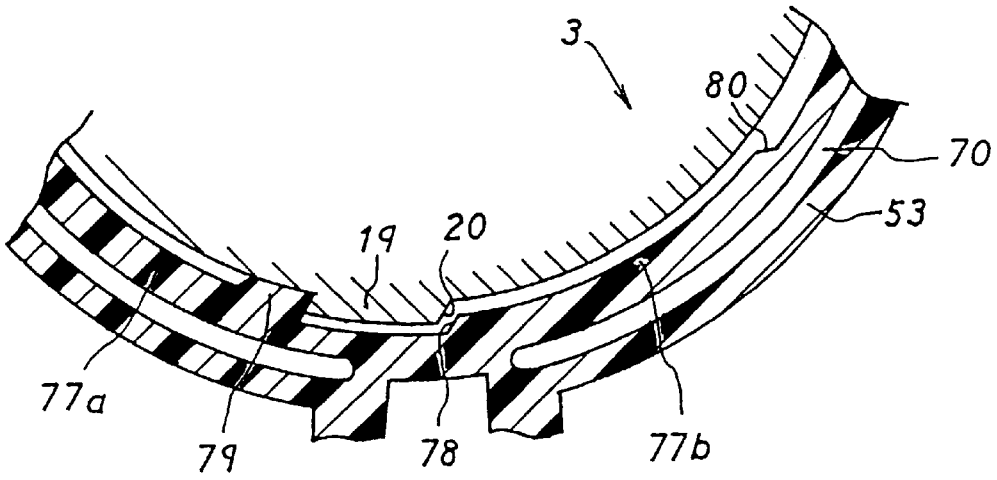
FIG. 9 is a fragmentary enlarged sectional view taken along the line 9—9 in FIG. 8*b*.

If the lid unit 5 which is in the closed state is rotated in the direction for opening the container 1, the whole lid unit 5 rises as shown in FIG. 7, causing the internal thread 35 of the inner lid 31 to disengage from the external thread 11 of the container body 3. It should be noted that in this embodiment the threads 11 and 35 are quadruple threads, as described above, and the thread engagement is undone by rotating the lid unit 5 through about 90 degrees from the tightened position, and that FIG. 7 shows a state where the lid unit 5 has been rotated slightly further in the opening direction after the disengagement of the threads 11 and 35. The state illustrated in FIG. 7 corresponds to that shown in FIG. 1*b*. FIG. 8*b* is an interior elevation of the lid mounting portion 13 of the container body 3 and the fitting member 53 of the lid unit 5 at this time, schematically showing the positional relationship between, on the one hand, the collar 15, the rotation-preventing stop 19 and the slide preventing stop 23 of the container body 3 and, on the other, the removal preventing abutments 77, the rotation-preventing engagement portion 79 and the slide-preventing engagement portions 81 of the fitting member 53. As will be clear from the figure, one abutment 77 abuts on the left end surface 21 of the rotation preventing stop 19 to limit further rotation of the lid unit 5 in the opening direction. The slide-preventing engagement portions 81 rest on the slide-preventing stoppers 23, and thus the slide-preventing stops 23 bear the whole lid unit 5. It should be noted that, in this state, there is a slight gap between the removal-preventing abutments 77 and the collar 15. However, if the lid unit 5 is pulled upwardly in this state, the removal-preventing abutments 77 come in contact with the collar 15 to prevent the lid unit 5 from coming off the container body 3. Further, in this state, the left end surface 78 of one 77*b* of the three removal-preventing abutments 77 lies in the immediate neighborhood of the right end surface 20 of the rotation-preventing stop 19. Thus, the lid unit 5 is prevented from undesirably rotating in the closing direction. FIG. 9 is a fragmentary enlarged sectional view taken along the line 9—9 in FIG. 8*b*. As will be understood from FIGS. 8*a*, 8*b* and 9, when the lid unit 5 shifts from the position shown in FIG. 8*a* to the position shown in FIG. 8*b*, one 77*b* of the removal-preventing abutments 77 rides over the rotation-preventing stopper 19 to reach the position shown in FIG. 8*b*. In order to make it easy for the abutment 77*b* to ride over the rotation-preventing stopper 19, the right end surface of the abutment 77*b* is formed as a slant surface 80. During the closing operation also, the abutment 77*b* rides over the rotation-preventing stopper 19 to reach the position shown in FIG. 8*a*. Therefore, in order to facilitate the movement of the abutment 77*b*, the left end surface of the abutment 77*b* is formed as a slant surface 78. It should be noted that the right end surface of the rotation-preventing stopper 19 is also formed as a slant surface 20. Although both the surfaces 20 and 78 are slanted, the abutment 77*b* requires a force of certain magnitude to ride over the rotation-preventing stopper 19. Accordingly, the lid unit 5 is prevented from undesirably shifting from the position shown in FIG. 8*b* to the position shown in FIG. 8*a*, that is, rotating in the closing direction, as has been described above.

If the lid unit 5 is in the state shown in FIG. 7, the lid body 30, that is, the combination of the outer and inner lids 55 and 31, can be raised to open the container 1, as shown in FIG. 1*c*, by disengaging the projection 97 from the engagement projection 75 of the fitting member 53. At this time, the snap action of the spring member 63 enables the opening operation to be effected by a one-touch simple operation and also allows the lid body 30 to be held in the open position; this is convenient in actual use. To close the container 1, the above-described procedure is reversed. It should be noted that, if the slide preventing stops 23 and the slide preventing engagement portions 81 are not provided, when the lid body 30 is raised to the open position, the fitting member 53, and hence the whole lid unit 5, would undesirably lower, making it difficult to return the lid body 30 to the closed position because of the interference between the lid body 30 and the end of the neck portion 7 of the container body 3. Accordingly, the provision of the slide-preventing stops 23 and the slide-preventing engagement portions 81 is extremely effective.

It should be noted that in the above-described embodiment the container body 3 is provided with only one rotation-preventing stop 19, and the fitting member 53 is also provided with only one rotation-preventing engagement portion 79. Therefore, when the lid unit 5 is to be mounted on the container body 3, it is necessary to take into consideration the positional relationship between the rotation-preventing stop 19 and the rotation-preventing engagement portion 79. A certain type of container has a casing mounted on an outer portion thereof, e.g. the front face, to accommodate a description of the drug contained therein. In such a case, it is desirable from the viewpoint of the relationship to the accommodating casing that the lid unit 5, the top of which has been pasted with a label including an indication concerning the drug contained, should be mounted so that the front face thereof is placed in a specific position relative to the container body 3. Therefore, it is recommended to employ an arrangement such as that of the above-described embodiment.

Figure 10:
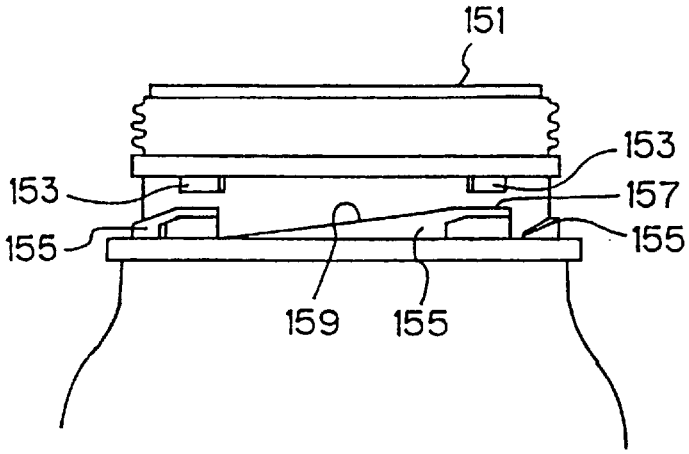
FIG. 10 is a fragmentary side view of a container body of a packaging container according to a second embodiment of the present invention.

On the other hand, in a case where the above-described accommodating casing is attached to the bottom of the container body, the lid unit need not be mounted so that the front face thereof is placed in a specific position relative to the container body. In such a case, it is rather preferable not to set the lid unit in a specific position from the viewpoint of facilitating the operation of mounting the lid unit onto the container body. FIG. 10 shows a container body 151 according to a second embodiment which has such an arrangement.

The container body 151 has four rotation-preventing stops 153 which are circumferentially spaced at equal intervals, and four slide-preventing stops 155 which are also circumferentially spaced at equal intervals. On the other hand, a lid unit (not shown) corresponding to the container body 151 has four rotation-preventing engagement portions which are circumferentially spaced at equal intervals, and four slide preventing engagement portions which are also circumferentially spaced at equal intervals. The rotation preventing and slide-preventing engagement portions are similar to those described with respect to the first embodiment. The rotation-preventing stops 153 may be arranged in the same way as in the first embodiment, and the arrangements of the rotation and slide-preventing engagement portions of the lid unit will be readily understood from the description of the first embodiment; therefore, description thereof is omitted.

Figure 11:
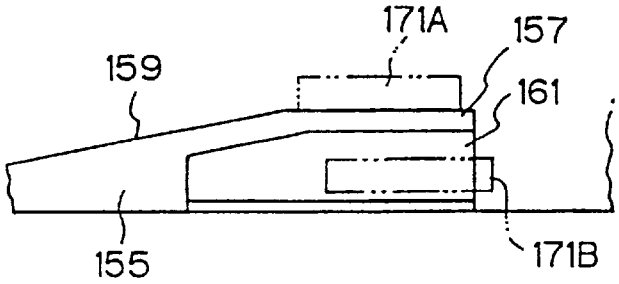
FIG. 11 is a fragmentary enlarged view showing in detail a slide preventing stopper in the second embodiment.
Figure 12:
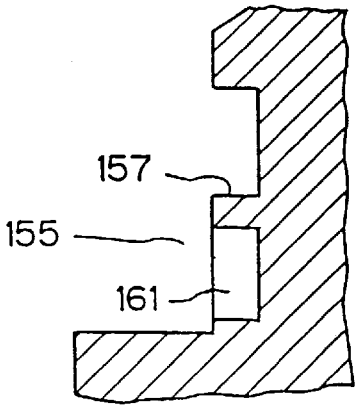
FIG. 12 is a fragmentary sectional view showing in detail a slide preventing stopper in the second embodiment.

FIG. 11 is an enlarged front view showing a slide-preventing stop 155 in detail, and FIG. 12 is a sectional view of the slide-preventing stop 155. As illustrated in these figures, the slide-preventing stop 155 has a flat portion 157 on which one slide-preventing engagement portion 171A of the lid unit rests when the lid unit is in the open position, and a slant portion 159 which is contiguous with the flat portion 157. The slant of the slant portion 159 approximately corresponds to the lead of the thread of the container body 151. Thus, when the lid unit is rotated, the slide-preventing engagement portions 171 of the lid unit move approximately along the respective slant surfaces 159 of the slide-preventing stops 155.

As is clearly shown in FIG. 12, each slide-preventing stop 155 has a recess 161 which is recessed in the radial direction of the container body at a position below the flat portion 157 and the slant portion 159. The recess 161 extends from the outer end of the flat portion 157 to a part of the slant portion 159. When the lid unit is in the closed position, the recess 161 receives at least a part of the slide-preventing engagement portion 171B, which is adjacent to the slide-preventing engagement portion 171A, as shown in FIG. 11. With this arrangement, the rotational angle of the lid unit, that is, approximately 90 degrees, is ensured.

Although in the above-described embodiment the container body 151 is provided with four rotation-preventing stoppers 153, and the lid unit is also provided with four rotation-preventing engagement portions corresponding to the rotation-preventing stops 153, it should be noted that either the number of rotation-preventing stops 153 or the number of rotation-preventing engagement portions may be one. Further, although the container body 151 is provided with four slide-preventing stoppers 155, and the lid unit is also provided with four slide-preventing engagement portions corresponding to the slide-preventing stops 155, the number of slide-preventing stops 155 and the number of slide-preventing engagement portions are not necessarily limited to four.

It should be noted that various changes and modifications may be imparted to the described embodiments within the scope of the present invention. For example, the arrangement for limiting the rotation of the fitting member 53 of the lid unit 5 is not necessarily limited to the arrangement comprising the rotation preventing stop 19 and the rotation-preventing engagement portion 79. For example, either the rotation preventing stop 19 or the rotation-preventing engagement portion 79 may be a recess. It is possible to adopt any arrangement that is capable of limiting the rotation of the fitting member 53 at a predetermined position. The same is true of the arrangement for preventing downward movement of the fitting member 53 at the openable position, which comprises the slide-preventing stops 23 and the slide-preventing engagement portions 81. Further, the arrangement for preventing the fitting member 53 from coming off is not necessarily limited to the arrangement according to the embodiment. Further, the outer lid 55 may have any arrangement whereby it can retain the inner lid 31 as one unit. That is, the outer lid 55 is not necessarily limited to a lid-shaped member, one end of which is substantially closed, as in the described embodiment. The outer lid 55 may comprise a pair of upper and lower rings and a plurality of ribs which connect the rings together.

Although in the foregoing embodiment the spring member 63 is provided as described above, it should be noted that, if the spring member 63 is not used, the arrangement may be such that the outer lid 55 is omitted, and the inner lid 31 is connected directly to the fitting member 53 by using a device similar to the hinges 57. In this case, the inner lid 31 should preferably be provided with an engagement projection 97 as is provided on the outer lid 55 in the described embodiment.

Figure 13:
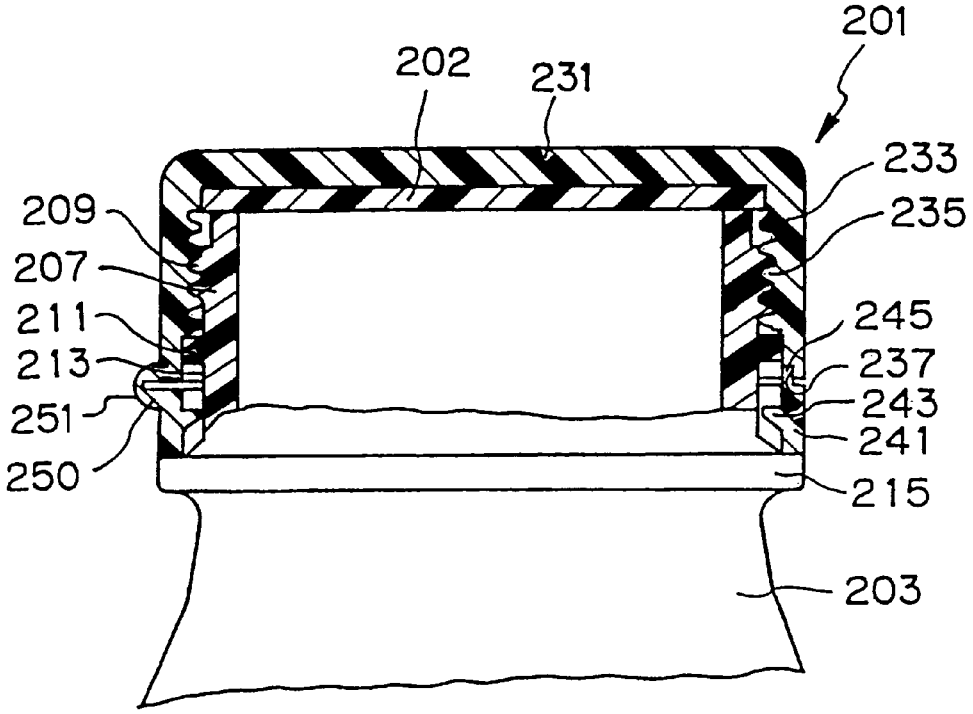
FIG. 13 is a partly-cutaway fragmentary sectional view of a packaging container according to a third embodiment of the present invention.

Next, a third embodiment of the present invention will be explained with reference to FIG. 13. FIG. 13 is a partly-cutaway fragmentary sectional view of a packaging container 201 according to the third embodiment.

The packaging container 201 comprises a container body 203 and a lid unit 231. The container body 203 has an external thread 209 cut in the upper peripheral portion of a neck portion 207 thereof in the same way as in the case of the container body in the first embodiment. Further, a collar 211 is formed below the external thread 209, and a lid mounting portion 213 is formed below the collar 211. The diameter of the lid mounting portion 213 is smaller than that of the collar 211. A lower collar 215 is formed below the lid mounting portion 213. The third embodiment differs from the first and second embodiments in that neither rotation-preventing stops nor slide-preventing stoppers are formed on the container body 203.

The lid unit 231 comprises a lid body 233 and a ring-shaped fitting member 241 which is rotatably fitted around the lid mounting portion 213 of the container body 203. The lid body 233 has an internal thread 235 which is engageable with the external thread 209 of the container body 203. The lid body 233 and the fitting member 241 are integrally molded from a plastic material. That is, the lid body 233 and the fitting member 241 are integrally connected by a connecting portion 250 which is formed at a position near the respective outer peripheral portions of the lid body 233 and the fitting member 241. A part of the connecting portion 250 is formed as a thin-walled foldable part to constitute a hinge 251. In this embodiment, the hinge 251 is provided at only one position. The inner periphery of the fitting member 241 is formed with a circumferential come-off preventing abutment 243. The abutment 243 is adapted to abut against the lower surface of the collar 211 of the container body 203, thereby preventing the fitting member 241 from coming off the container body 203, and thus preventing the whole lid unit 231 from separating from the container body 203.

FIG. 13 shows the packaging container 201 which is completely closed with the lid unit 231. In this state, the lid unit 231 ensures a high degree of hermeticity by compressing a packing 202 between it and the upper end opening of the neck portion 207 of the container body 203. If the lid unit 231 which is in the illustrated state is rotated in the opening direction, the thread engagement between the lid body 233 and the container body 203 is undone. A projection 245 extends upwardly from the upper end surface of the fitting member 241 at a position opposite to the hinge 251. The projection 245 is fitted in a cut portion 237 formed in the lower end surface of the lid body 233. Accordingly, when the lid unit 231 is rotated in the opening direction, the fitting member 241 rises together with the lid body 233. It is convenient to form the projection 245 and the cut portion 237 in a reverse-tapered configuration. After the lid body 233 has disengaged from the container body 203, the projection 245 is disengaged from the cut portion 237, and the lid body 233 is pivoted in the counterclockwise direction as viewed in the figure by using the hinge 251, thereby opening the container 201. It should be noted that the dimension of the upper end portion of the neck portion 207 of the container body 203 must be set so that the upper end portion of the neck portion 207 will not interfere with the lid body 233 when pivoted.

Unlike the first and second embodiments, the third embodiment has no arrangement for preventing sliding. Therefore, if the user takes his/her hand off the lid body 233 after the lid has been opened, the fitting member 241, and hence the lid unit 231, is likely to move downwardly. It is, of course, possible to provide a slide-preventing structure and also an over-rotation-preventing structure in the same way as in the first and second embodiments.

As will be clear from the foregoing description, the packaging container according to the present invention has a lid unit which is opened and closed by thread engagement with an external thread formed on the outside of an opening of the container body. The lid unit includes a lid body capable of hermetically sealing the opening of the container body, and a fitting member which is undetachably mounted on the container body. The lid body is provided with a thread which is engageable with the thread formed on the outside of the opening of the container body. Accordingly, the present invention provides an arrangement which enables completely hermetic sealing of a container even in the case of a container having a large diameter, which hermetic sealing has heretofore been strongly demanded with respect to packaging containers for drugs in particular, and in which arrangement the lid does not separate from the container body when the container is opened. Thus, it becomes possible to put a drug identification indication on the lid top without the risk of erroneous prescription, and hence possible to achieve a high efficiency of dispensing work.

If the lid body and the fitting member are integrally molded from a plastic material, and a thin-walled portion is provided at the joint of the lid body and the fitting member to form a hinge whereby the lid body and the fitting member can tilt relative to each other, the production cost is reduced, and the lid unit becomes convenient for handling.

In a case where a snap-action spring member is provided between the lid body and the fitting member, the opening operation can be effected by a one-touch simple operation. Thus, the ease of use is enhanced.

If the lid body comprises an inner lid and an outer lid, and the outer lid is connected to the fitting member, and further a snap-action spring member is disposed in a cut portion formed in the outer lid, the spring member will not project outwardly from the lid unit when the container is in a stoppered state. Thus, the arrangement is convenient for storing the container in a drawer or the like.

If the container is provided with a rotation-preventing device for preventing further rotation of the fitting member after the thread engagement has been undone by rotating the lid unit through a predetermined angle, no excess rotating operation will be performed. Therefore, the efficiency of the dispensing work is further improved.

Particularly, if multiple threads are used, and the required rotation angle is set at a small angle, specifically an angle smaller than 360 degrees, more desirably approximately 90 degrees, it is possible to effect the opening operation in a short time while ensuring high hermeticity for the container.

If the container is provided with a slide-preventing device for preventing downward movement of the fitting member after the thread engagement has been undone, even when the lid body is raised to open the container, the fitting member, and hence the lid unit, will not move downwardly; this is extremely convenient for the subsequent stoppering operation. Thus, the operating efficiency can be further improved.

If a locking member for releasably locking together the lid body and the fitting member is provided at a position opposite to the connecting member, the unitariness of the lid body and the fitting member is conveniently ensured even more effectively when the lid body is rotated; this is convenient for handing.

Although the present invention has been described through specific terms, it should be noted here that the described embodiments are not necessarily exclusive and that various changes and modifications may be imparted thereto without departing from the scope of the invention which is limited solely by the appended claims.

We claim:

1. A container with a screw cap comprising:

a container body with a neck portion having an opening at an upper end thereof, and a lid unit for opening and closing said opening, wherein said neck portion of said container body includes an external thread cut in an upper portion of an outer periphery of said neck portion, and a cylindrical lid mounting portion having a predetermined height, said lid mounting portion being formed below said external thread, and wherein said lid unit includes: a lid body having a cylindrical side wall which has an internal thread cut in an inner periphery thereof, said internal thread being threadingly engaged with said external thread of said container body, said lid body further having a top wall which closes a top of said side wall; a fitting member having a cylindrical portion which is rotatably and undetachably fitted around said lid mounting portion of said container body in such a manner that vertical movement of said fitting member is restricted within a predetermined range; and a connecting member integrally and undetachably formed with said lid body and said fitting member for connecting said lid body to said fitting member in such a manner that a lower surface of said side wall of said lid body rests on and separates from an upper surface of said fitting member, and said container and said fitting member further comprise over-rotation-preventing members, said over-rotation-preventing member of said container engaging with said over-rotation-preventing member of said fitting member when said lid unit rotates in an opening direction relative to said container body as far as a position where said external thread and said internal thread disengage from each other, to prevent further rotation of said fitting member in said opening direction relative to said container body.

2. A container with a screw cap according to claim 1, wherein:

said over-rotation-preventing members are projections which are respectively formed on an outer periphery of said lid mounting portion of said container body and on an inner periphery of the cylindrical portion of said fitting member.

3. A container with a screw cap according to claim 1, further comprising: slide-preventing members on said lid unit and on said container body, said slide-preventing members on said lid unit engaging with said slide-preventing members on said container body when said lid unit rotates relative to said container body as far as the position where said external thread and said internal thread disengage from each other to prevent downward movement of said fitting member relative to the container body.

4. A container with a screw cap according to claim 3, wherein:

said slide-preventing members are projections which are respectively formed on an outer periphery of said lid mounting portion of said container body and on an inner periphery of the cylindrical portion of said fitting member.

5. A container with a screw cap according to claim 3, wherein:

said lid body includes an inner lid having said cylindrical side wall and said top wall, and an outer lid which fixedly receives said inner lid therein by using rotation-preventing means and removal preventing means.

6. A container with a screw cap according to claim 5, wherein:

said outer lid and said fitting member are integrally molded from a plastic material, and wherein said connecting member includes connecting portions respectively formed near the outer peripheries of said lid body and the fitting member, said connecting portions being connected with each other through a foldable wall portion provided therebetween which functions as a hinge.

7. A container with a screw cap according to claim 6, wherein:

said outer lid has a cut portion formed in a circumferential part thereof, said cut portion extending from a lower end of said side wall to said top wall, said lid unit further including a generally L-shaped spring member, said spring member being connected at one end thereof to an end portion of said cut portion which is closer to said top wall by a wall portion which functions as a hinge, said spring member being connected at the other end thereof to an outer peripheral portion of said fitting member which faces said cut portion by a thin-walled portion which functions as a hinge, and said spring member biasing said lid body in one of a direction in which said lid body rests on said fitting member in a direction in which said lid body separates from said fitting member when said lid body has passed a neutral point during pivoting relative to said fitting member.

8. A container with a screw cap according to claim 7, wherein:

said lid unit further includes a locking member for releasably locking together said lid body and said fitting member at a position which is diametrically opposite to said connecting member.

9. A container with a screw cap according to claim 3, further comprising:

a closing direction rotation-preventing member which yieldably prevents said lid body from rotating in the reverse direction relative to said container body when said lid body rotates relative to said container body as far as the position where said external thread and said internal thread disengage from each other.

10. A container with a screw cap according to claim 9, wherein:

said over-rotation-preventing members are projections which are respectively formed on an outer periphery of said lid mounting portion of said container body and on an inner periphery of the cylindrical portion of said fitting member, of said closing-direction rotation-preventing member is a projection formed on the inner periphery of said cylindrical portion of said fitting member and circumferentially spaced apart from said over-rotation-preventing projection on the inner periphery of said cylindrical portion so that said closing-direction rotation-preventing projection is positioned opposite to said over-rotation-preventing projection on the inner periphery of said cylindrical portion with respect to said projection formed on the outer periphery of said fitting member when said lid body rotates relative to said container body as far as the position where said external thread and said internal thread disengage from each other.

11. A container with a screw cap according to claim 10, wherein:

said closing-direction rotation-preventing projection resiliently rides over said projection formed on the outer periphery of said lid mounting portion of said container body while said lid body rotates relative to container body with said outer and inner threads are engaged with each other.

12. A container with a screw cap according to claim 1, wherein:

said lid body includes an inner lid having said cylindrical side wall and said top wall, and an outer lid which fixedly receives said inner lid therein by using rotation-preventing means and removal preventing means.

13. A container with a screw cap according to claim 12, wherein:

said outer lid and said fitting member are integrally molded from a plastic material, and wherein said connecting member includes connecting portions respectively formed near the outer peripheries of said lid body and the fitting member, said connecting portions being connected with each other through a foldable wall portion provided therebetween which functions as a hinge.

14. A container with a screw cap according to claim 13, wherein:

said outer lid has a cut portion formed in a circumferential part thereof, said cut portion extending from a lower end of said side wall to said top wall, said lid unit further including a spring member having two ends, said spring member being connected at one end thereof to an end portion of said cut portion which is closer to said top wall by a thin-walled portion which functions as a hinge, said spring member being connected at the other end thereof to an outer peripheral portion of said fitting member which faces said cut portion by a wall portion which functions as a hinge, and said spring member biasing said lid body in a direction in which said lid body rests on said fitting member or in a direction in which said lid body separates from said fitting member when said lid body has passed a neutral point during pivoting relative to said fitting member.

15. A container with a screw cap according to claim 14, wherein:

said lid unit further includes a locking member for releasably locking together said lid body and said fitting member at a position which is diametrically opposite to said connecting member.

16. A container with a screw cap according to claim 1, wherein said fitting member rotates and moves upward and downward together with said lid body when said lid body threadingly rotates and moves upward and downward relative to said container body.

* * * * *